US005765251A

United States Patent [19]

Jones

[11] Patent Number: 5,765,251

[45] Date of Patent: Jun. 16, 1998

[54] SELF ADJUSTING DEVICE FOR REMOVAL OF OBSTRUCTIONS FROM DRAIN PIPES

[76] Inventor: Bernard Thomas Jones, 8550 Midpark #317, Dallas, Tex. 75240

[21] Appl. No.: 825,715

[22] Filed: Apr. 4, 1997

Related U.S. Application Data

[60] Provisional application No. 60/015,127, Apr. 10, 1996.

[51] Int. Cl.[6] ..... B08B 9/02

[52] U.S. Cl. ..... 15/104.32; 15/104.33; 294/100

[58] Field of Search ..... 15/104.05, 104.31–104.33; 294/93, 100

[56] References Cited

U.S. PATENT DOCUMENTS

| | | | |
|---|---|---|---|
| 1,051,992 | 2/1913 | Fisher et al. | 15/104.32 |
| 1,738,836 | 12/1929 | Boves | 15/104.33 |
| 2,212,013 | 8/1940 | Devareaux | 294/100 |
| 2,694,822 | 11/1954 | Murphy | 15/104.33 |
| 3,950,934 | 4/1976 | Irwin | 15/104.33 X |
| 4,340,988 | 7/1982 | Shames et al. | 15/104.33 |
| 5,230,116 | 7/1993 | Rodriguez | 15/104.33 |
| 5,276,934 | 1/1994 | Brzoska | 15/104.32 X |

*Primary Examiner*—Mark Spisich

[57] ABSTRACT

A flexible wire wound cable (13) which surrounds a wire cluster (11) terminated in a hook (16). A handle (10) attached to the wire cluster allowing urging of the wire cluster in sliding motion inside the flexible tube. A handle (13) attached to the flexible tube allowing firm gripping of the flexible tube. A wire cluster (11) made of spring wire and formed to a curl at its extremity (15) and terminating in a hook (16). A hollow cap (14) fixed to the end of the flexible wire wound cable (13). A point with holes in it through which the spring wire can slide and protrude in varying length.

1 Claim, 2 Drawing Sheets

SELF ADJUSTING DEVICE FOR REMOVAL OF OBSTRUCTIONS FROM DRAIN PIPES

Figure 1:
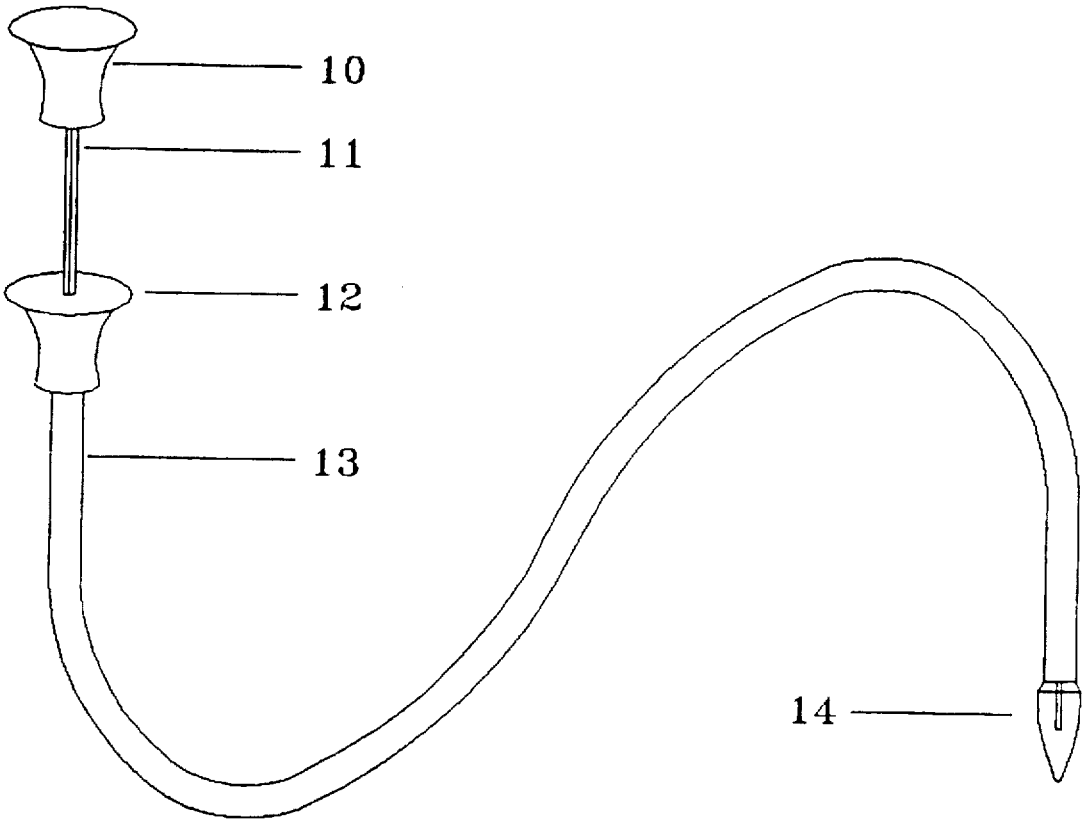

This application claims the benefit of U.S. provisional application No. 60/015,127, filed Apr. 10, 1996.

BACKGROUND

1. Field of Invention

This invention relates to the removal of obstructions from drain pipes, particularly but not limited to, curved pipes of small diameter or of small entry orifice.

2. Description of Prior Art

Obstructions in drain pipes have caused drainage problems as long as drainage pipes have been in existence. This is particularly true of drains accepting discharge from sinks, bathtubs, and toilets. Hair, fabric, paper towels, and facial tissue are the most common obstructions found in bathroom drain pipes.

Bathtub, sink, and toilet drains have short-radius curves or S-curves. Most bathtub and sink drains contain drain stopper linkage. This linkage provides a partial barrier which restricts fluid flow and collects solid material thus making access to obstructions difficult or impossible for large diameter tools and cleaning devices.

Until now the solution to the obstruction problem in small drain pipes has been to dismantle the piping to permit access. Another approach is to pour chemicals into the drain and wait a lengthy amount of time for the chemical to dissolve the obstruction.

Still, a third approach is the use of various mechanical devices for removal of obstructions while leaving the piping intact.

A discussion of the more prominent obstacle removal devices is as follows:

Flexible Cable Augers ("Snakes")

U. S. Pat. No. 4,340,988 (1982) to Shames is a helically wound wire cable with a bulbous corkscrew termination. This wire wound cable is capable of simultaneous rotation, curling, and sliding along its longitudinal axis.

However, the outside diameter of the cable must be large enough to sustain significant torsional stress involved with the rotation, thus limiting the radius of curvature at which it can bend and/or rotate.

The bulbous, corkscrew cable termination may be screwed through a small entry orifice but must be unscrewed to remove it from the entry orifice, thus releasing captured material inside the pipe.

Flexible Cable Graspers Another method used in removing obstacles from pipes is a grasping device mounted on the working end of a flexible cable; for example, U. S. Pat. to Murphy 2,694,822. Murphy's invention is capable of corkscrewing into obstacles and pulling them into compressible tines. The tines are then compressed about the obstacle in a grasping manner, thus making removal of the grasped material possible by withdrawing it by means of an attached flexible cable.

The limitations of Murphy's device are similar to those mentioned earlier in this writing with reference to orifice entry and maneuverability around pipe bends. Also, the object to be grasped must be smaller than the maximum expansion of the tines. Another limitation lies in the trial and error nature of locating the obstacle to be grasped.

In general, the prior art search by this inventor revealed limitations as follows:

(a) cannot enter small entry orifices, (b) cannot make small radius bends, (c) tend to compact obstructions or force them farther down the pipe, (d) require multi-step manufacturing processes, (e) the ribbed nature of the cable makes sliding difficult and provides a catch point for dirt and odor, (f) relatively heavy and cumbersome.

The invention introduced here is designed to overcome the limitations of prior art and provide unique advantages of itself.

The advantages of this invention are as follows:

(a) lightweight, (b) eye appealing, (c) easily manufactured, (d) self adjusting, (e) easily cleaned, (f) durable, (g) easily maintained, (h) maneuverable, (i) non destructive to commonly used plumbing pipes, (j) manually adjustable, (k) eliminates guesswork, (l) user friendly—no bruised knuckles or pinched fingers, (m) rotatable for selective hook positioning, (n) comparative simplicity, (o) functional superiority, and (p) ease of operation.

OBJECTS AND ADVANTAGES

Accordingly, besides the objects and advantages of the obstruction removers described in my above statements, several objects and advantages of the present invention are:

(a) to provide a device which has two moving parts, thus simplifying manufacturing processes, increasing reliability, and minimizing operational difficulty;

(b) to provide a device which is easily cleaned after use, thus minimizing odors and bacteria carrying dirt;

(c) to provide a device which is lightweight, easily transported and stored;

(d) to provide a device capable of reaching places heretofore inaccessible.

Further objects and advantages are to provide a device which is used easily and conveniently to produce satisfactory results that cannot be accomplished by other devices.

DRAWING FIGURES

In the drawings

FIG. 1 shows the various aspects of the device with the flexible cable 13 curled to illustrate the flexible nature of the cable 13. FIG. 1 shows the device with the spreader section 15 and hook section 16 in the retracted position.

Figure 2:
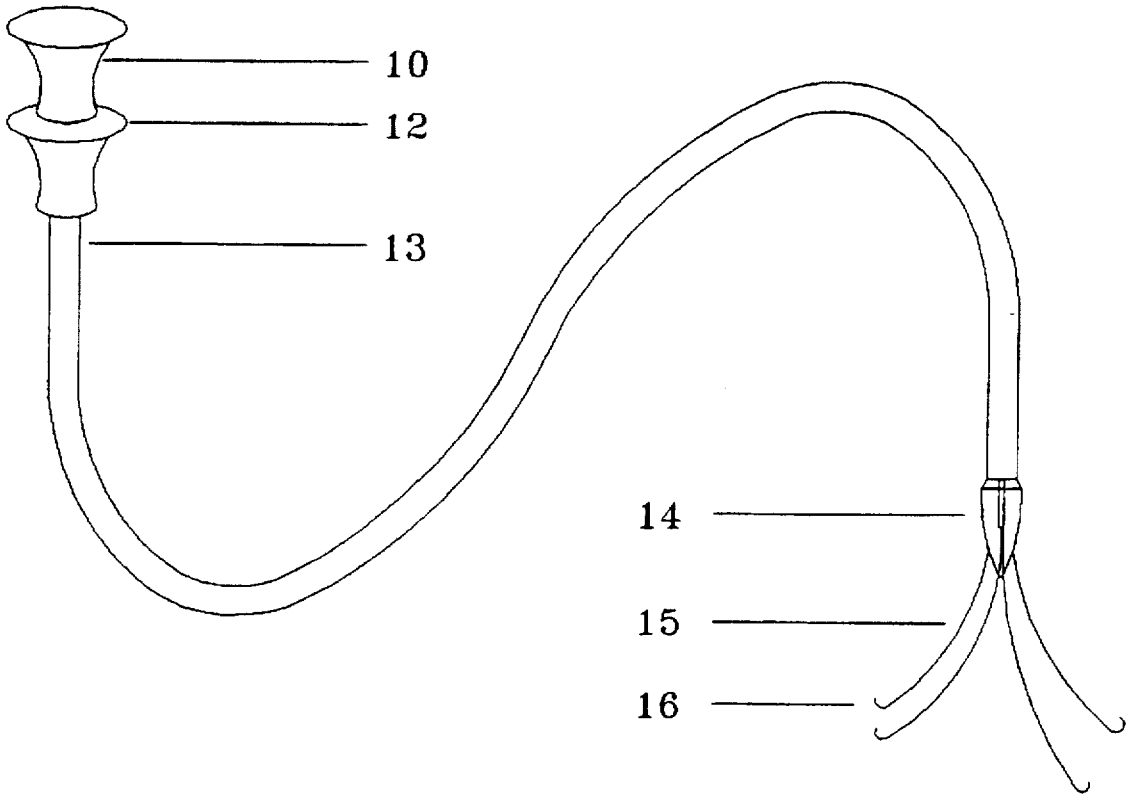

FIG. 2 shows the various aspects of the device with the flexible cable curled to illustrate functionality of the device while the flexible cable is in the curled position. FIG.2 shows the device with the spreader section 15 and hook termination 16 in the expanded position.

REFERENCE NUMERALS IN FIGS. 1, 2 DRAWINGS

10 Push-Pull handle

11 Spring wire cluster shaft

12 Push-Pull handle
13 Plastic coated wire wound flexible cable
14 Penetrating-protector point
15 Spreader section of wire cluster
16 Hook section of wire cluster

DESCRIPTION—FIGS. 1 AND 2

A typical embodiment of the present invention is illustrated in FIG. 1 (side view-hooks retracted position) and FIG.2 (side view-hooks expanded position). The invention has a handled 10 contoured for comfortable hand gripping in pushing or pulling within necessary functional limits. The handle 10 is drilled and tapped for a set screw used in securing the cluster 11 to handle 10. The handle 10 is made of any material strong enough to retain its structural integrity and functionality throughout normal use. A cluster of spring wire 11 is fastened in handle 10 by use of a set screw. Plastic coated wire wound cable 13 e spring wire cluster. A push-pull handle 12 is secured to the plastic coated wire wound flexible cable 13 by use of a set screw. The spreader section 15 of the spring wire cluster is a gently curling wire terminating in a hook 16. A penetrator-protector point 14 is secured to the plastic coated wire wound cable. A hollow penetrating-protector point 14 is secured to the plastic coated wire wound flexible cable. The penetrating-protector point 14 has holes in it, allowing the spreader section 15 to pass through it.

OPERATION—FIGS. 1, 2

Operation of the device shown in FIGS. 1, 2 is as follows:

1) Pull handle 10 away from handle 12 to the maximum allowable displacement, thus pulling the spreader section 15 into the surrounding plastic coated wire wound flexible cable 13. 2) Insert the plastic coated wire wound flexible cable 13 through the opening of the obstructed pipe to a depth equal to the length of the plastic coated wire wound cable 13 or at a depth estimated to be beyond the obstacle to be removed. The smooth exterior of the plastic coated wire wound cable 13 allows ease of entry. The penetrating-protector point 14 guides the plastic coated wire wound cable 13 in forward motion and prevents entry of foreign material into the plastic coated wire wound cable 13. Also, the penetrating-protector point 14 contributes to penetration of obstructing material. Another function of the penetrating-protector point 14 is to conceal the hooks 16 when the spreader section 15 of the spring wire cluster is constrained inside the plastic coated wire wound cable 13, thus preventing unwanted snagging of the hooks 16 while the spreader section 15 is in the constrained position. In most cases, the plastic coated wire wound cable 13 surrounding the spring wire cluster 11 and the spreader section of the wire cluster 15 will penetrate or be guided past obstructions by the penetrating protector point 14. 3) Pull handle 12 toward handle 10 while holding handle 10 stationary, thus pulling the plastic coated wire wound flexible cable toward handle 10 and allowing the spreader section 15 of the wire cluster 11 to expand radically outward. Consequently, the hook termination 16 of the wire cluster 11 is placed in an active position. 4) Withdraw the plastic coated wire wound flexible cable 13 surrounding the spring wire cluster 11 with the spreader section 15 of the spring wire cluster 11 in the expanded position by pulling on handle 12. The expanded spreader section 15 of the wire cluster 11 brings the hook section 16 of the wire cluster 11 to the outer limits of the prestressed configuration of the spreader section of the wire cluster 11. A secondary consideration is that the radically outward movement of the spreader section 15 of the wire cluster 11 is limited by the inside diameter of the pipe. The spring nature of the spreader section 15 of the wire cluster 11 allows conformity to variations in pipe diameter and allows it to yield to fixed objects such as stopper linkage or pipe intersections, thus adjusting itself for maximum exposure to movable obstructions in the pipe. The spreader section 15 of the wire cluster 11 keeps the hook section 16 of the wire cluster 11 at maximum radially outward distance and guides obstacles in its withdrawal path into the hook section 16 of the wire cluster 11. If the withdrawn hook section 16 of the wire cluster 11 shows evidence of foreign material, repeat steps 1 through 4.

If a second attempt shows no evidence of foreign material on the hook section 16 of the wire cluster 11, it is reasonable to conclude that significant obstructions in the pipe have been removed, at least to the depth of insertion of the plastic coated wire wound flexible cable 13.

PARTS PROCUREMENT

REFERENCE FIGS. 1, 2

(a) Handle 10, wire 11, handle 12 can be found at most hardware stores;

(b) Cable 13 can be found at hardware stores or bicycle shops;

(c) Point 14 is the pointed end of a knitting needle found at most sewing centers;

(d) Spreaders 15 and hooks 16 are a modification of wire cluster 11.

MANUFACTURING PROCESS

It is assumed that the person attempting to manufacture the above described device is knowledgeable in the use of basic hand tools and elementary machine-shop techniques.

After procuring the materials listed above the alteration of these parts is as follows:

1) Starting with a cluster of straight spring wires, align them in an axially parallel position as close together as possible. Place the ends of the wires even with one another. Solder, weld, epoxy, crimp, or otherwise secure the wires together over a length from the even end sufficient to prevent relative rotation about their respective longitudinal axises. Also, securing the wires together provides a load-bearing seat for a set screw. The length, size, and number of wires is left to the choice of the individual based on the task to be accomplished. 2) Drill and tap both push-pull handles 10 and 12 perpendicular to the longitudinal axis to accommodate a set screw. 3) Drill handle 10 along the longitudinal axis to a depth intersecting the abovementioned set screw hole. 4) Drill handle 12 completely through along the longitudinal axis to accommodate the flexible cable 13. 5) Assemble as shown in FIG. 2 with wires protruding from the end of cable 13. 6) Bend wires to form spreaders 15 and hooks 16. 7) To make a penetrating-protector point 14, cut the pointed end from a hollow knitting needle. Cut slots parallel to the longitudinal axis of the point 14, to accommodate the passage of spreaders 15. Assemble as shown in FIG.1.

SUMMARY, RAMIFICATIONS, AND SCOPE

Accordingly, the reader will see that the drain pipe obstruction removal invention described herein is comparatively simple to manufacture, easy to operate, and is functionally superior to devices currently on the market.

Furthermore, the drain pipe obstruction removal invention described herein has additional advantages in that:

it enters small openings;

it slides easily through small orifices;

it is sturdy, reliable, lightweight, maneuverable, clean and easily disinfected;

it takes out the guesswork in locating obstructions;

it will not damage soft metals such as brass, cooper, and lead;

it will not hang in the pipe;

it may be produced on a larger scale using the same method for larger pipes;

it may be produced using hydraulic, pneumatic, or mechanical actuating means for expanding and contracting the spreader-hook assembly;

it may be produced with a plurality of wires to form a brush in the expanded position;

the outer wire wound flexible cable can be replaced with a rigid tube or a combination of flexible and rigid tubing;

rotation of one push-pull handle relative to the other while the spreader-hook is in the expanded position causes the hooks to turn radially inward in a grasping motion.

Although the description above contains many specifications, these should not be construed as limiting the scope of the invention but as merely providing illustrations of some of the presently preferred embodiments of this invention. For example, the spreader-hook configuration may be altered to better perform a unique task such as grappling of solid objects.

Thus, the scope of the invention should be determined by the appended claims and their legal equivalents, rather than by the examples given.

I claim:

1. A device for the removal of obstructions from drain pipes comprising:

(a) an elongated flexible plastic coated tube having opposite first and second ends;

(b) a plurality of elongated wire members located within and extending along said tube, said wire members each having a working end having a gradual curve terminating in a hook, each of the hooks extend in a direction away from the longitudinal axis of the tube;

(c) a first handle secured to each of the wire members at an end thereof opposite the working ends, said first handle being movable relative to the tube and adapted to urge the wire members in a sliding motion relative to the tube, (d) a second handle secured to the first end of the tube, said second handle being fixed relative to the tube and adapted to urge the tube as well as the wire members in a sliding motion;

(e) a cap secured to the second end of the tube, the cap having a plurality of holes formed therein each for receiving a respective one of the wire members, and (f) whereby the wire members are adapted to assume a retracted position wherein the hooks thereof are located closely adjacent the cap so as not to interfere with the insertion of the device into the pipe being cleaned and an expanded position wherein the hooks thereof are expanded outwards away from the longitudinal axis of the tube.

* * * * *